United States Patent [19]

Lucky

[11] Patent Number: 4,638,786

[45] Date of Patent: Jan. 27, 1987

[54] MAGNETIC UTENSIL-HOLDER

[76] Inventor: Lloyd P. Lucky, P.O. Box 670803, Chugiak, Ak. 99567

[21] Appl. No.: 696,292

[22] Filed: Jan. 30, 1985

[51] Int. Cl.[4] ..... F24C 15/30

[52] U.S. Cl. ..... 126/24; 126/27; 126/218; 126/215; 428/206.5; 335/285; 335/302; 206/818

[58] Field of Search ..... 126/24, 27, 218, 211, 126/214 C, 215; 248/206.5; 206/818; 335/285, 302, 306

[56] References Cited

U.S. PATENT DOCUMENTS 3,245,400 4/1966 Bowman ..... 248/206.5
3,423,708 1/1969 Christian ..... 126/24 X

FOREIGN PATENT DOCUMENTS 267943 10/1948 Switzerland ..... 248/206.5

*Primary Examiner*—Randall L. Green
*Attorney, Agent, or Firm*—Griffin, Branigan, & Butler

[57] ABSTRACT

A magnetic utensil-holder (10) has a first ring (12) having magnets (19) therein that are placed on a cooking surface, such as a stove top or grill, surrounding a heat source. A second ring (20) is spaced a predetermined distance above the first ring (12) by a plurality of support means (28,30). A cooking utensil is placed inside of the holder (10) and a plurality of adjustment means (33) are adjusted until they contact the cooking utensil. The cooking utensil is thus held firmly on the cooking surface. Extension pins (40) extend above the second ring (20) to prevent pot lids from sliding off; and, joinder bars (45) coact with the extension pins (40) to fasten two such magnetic utensil-holders together.

21 Claims, 6 Drawing Figures

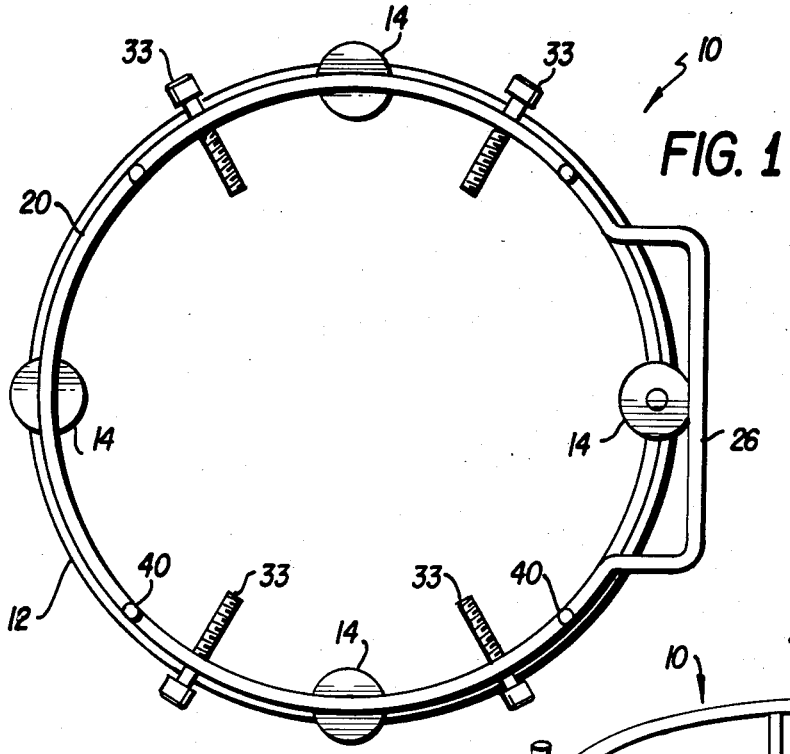
FIG. 1
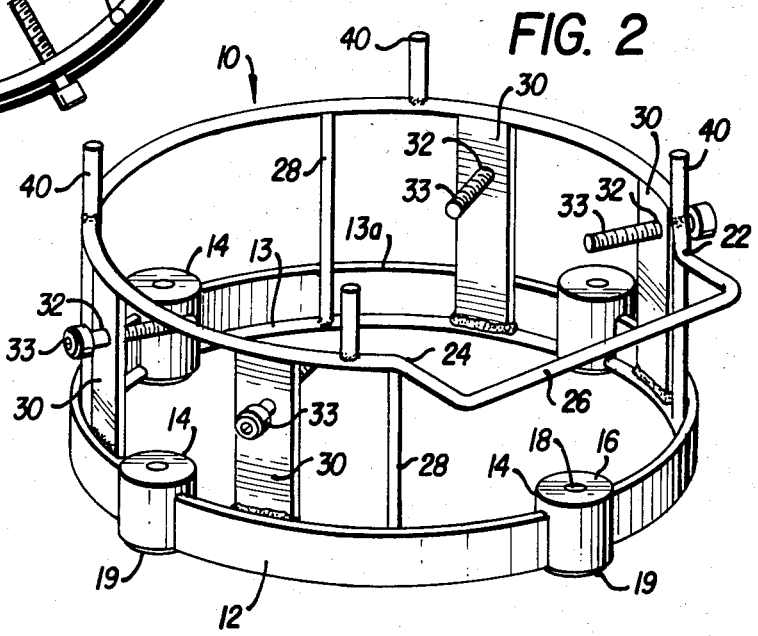
FIG. 2
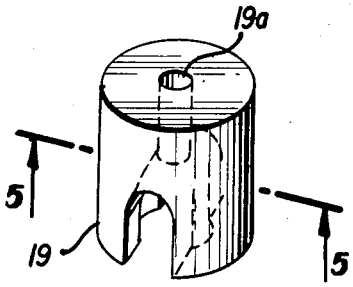
FIG. 3
FIG. 4
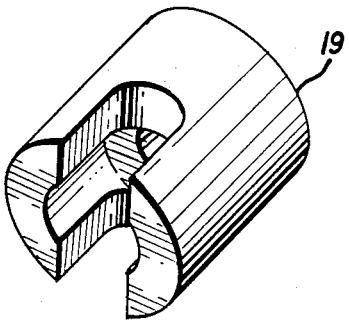
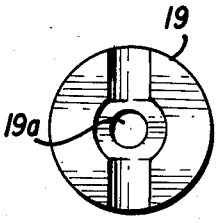
FIG. 5
FIG. 6
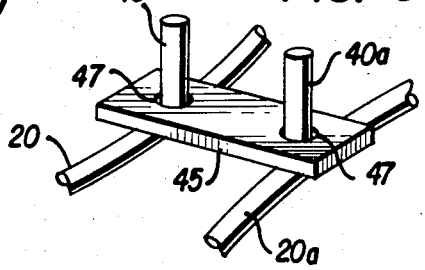

MAGNETIC UTENSIL-HOLDER

BACKGROUND OF THE INVENTION

The invention relates to a magnetic utensil-holder for supporting a cooking utensil on a cooking surface. In this respect, cook stoves on moving vehicles are often bounced about and, during stormy weather seagoing vessels are often tossed at sea. Hence, in such instances, it is difficult to cook as the pots and pans placed on a stove top or grill tend to fall. Moreover, cooks in such instances are often severely burned by the contents of cook pots and the like. Hence, it is important to be sure that such utensils do not move about on such stoves or grills. Accordingly, the instant invention provides a magnetic utensil holder that securely holds a cooking utensil, such as a pot, on the cooking surface during such bouncing and turbulence. In this manner the contents of the utensils are retained therein and the attending cooks are not burned.

U.S. Pat. No. 3,198,189 to Oatley discloses a safety device for cooker hobs employing a ring adapted to closely encircle a pan. Such a device requires a modification of the stove top to provide a means for anchoring the holder to the stove top. Additionally, this device cannot accommodate various pan sizes.

U.S. Pat. No. 3,423,708 to Christian discloses a magnetic holder for pots and pans comprising a pair of magnetic sheets having a concave edge. One sheet is placed on each side of the pot with the concave edge facing inwardly to engage the periphery of the pot. Such a holder, however, is not satisfactory for stove tops having a grate over the cooking area as the holder may not be in proper engagement with the pot. The present invention overcomes these problems by providing a magnetic utensil-holder that does not require any modification of the stove with which it is to be used.

In view of the foregoing, it is an object of the present invention to create an improved utensil-holder that is simple to manufacture, but still protects the cook from burns or other injury by preventing the utensil from sliding off of its burner.

An advantage of the invention is that it does not require alteration to the cooking surface upon which the utensils are to be located.

Another advantage of the present invention is that it is capable of accommodating various cooking utensil sizes. Moreover, several devices of the invention can be hooked together so that they can assist each other in maintaining stability; and, one embodiment of the invention is operative to also present accompanying pot lids from sliding off.

SUMMARY

A magnetic utensil-holder has a first ring having magnets therein that are placed on a cooking surface, such as a stove top or grill, surrounding a heat source. A second ring is spaced a predetermined distance above the first ring by a plurality of supports. A cooking utensil is placed inside of the holder and a plurality of adjustment means are adjusted until they contact the cooking utensil. The cooking utensil is thus held firmly on the cooking surface.

Additional protrusions from the second ring project upwardly to prevent accompanying pot lids from sliding off and also provide a means for coacting with a joinder or fastening bar for fastening several of the magnetic utensil-holders together.

BRIEF DESCRIPTION OF THE DRAWINGS

FIG. 1 is a top view of a magnetic utensil-holder of the invention;

FIG. 2 is a perspective view of the utensil-holder of the invention;

FIG. 3 is a perspective view of one side and top of a magnet used with the devices of FIGS. 1 and 2;

FIG. 4 is a perspective view of one side and bottom of the magnet of FIG. 3;

FIG. 5 is a cross-sectional view of the FIG. 5 magnet along lines 5—5′; and, FIG. 6 is a perspective view of a joinder bar for use with two or more of the utensil holders of the invention.

DETAILED DESCRIPTION OF THE DRAWINGS

A magnetic utensil holder 10 is manufactured from a material capable of withstanding the heat produced by a cooking surface, such as a stove top or grill. One such suitable material is stainless steel.

The magnetic utensil holder 10 comprises a substantially circular first ring 12, a substantially circular second ring 20 having a handle 26, and a plurality of thin and wide support means 28 and 30 respectively to support the second ring 20 a predetermined distance above the first ring 12.

The first ring 12 is a compound element comprised of a rounded circular rod 13 and a circular bar 13*a* affixed thereto. The ring 12 has a plurality of magnetic securing means comprising substantially circular cylinders 14 attached to the ring. For convenience only four such cylinders are illustrated, but six or more have been successfully used and five are presently preferable.

Each cylinder 14 has a threaded hole 18 and an open bottom. Housed within each cylinder 14 is a magnet 19. Each such magnet has an inverted U-shape (FIGS. 3–5) with a hole 19*a* through its center. Each magnet 19 is inserted into one of the cylinders 14 and secured in place by a screw (not shown) which goes through the hole 19*a* of the magnet and is screwed into threaded hole 18 of cylinder 14. The magnets are slightly longer than the length of the cylinder so that the magnets slightly protrude from the open end of the cylinder as indicated in FIG. 2.

The second ring 20 is spaced a predetermined distance above the first ring 12 by a plurality of thin support means 28 and wide support means 30. Each wide support includes a threaded hole 32 to accept an adjustment means 33, such as a screw. These screws 33 are used to adapt the holder 10 to a variety of different sized utensils. In this respect, by use of the screws 33 pots of $2\frac{3}{4}$ quarts, $3\frac{3}{4}$ quarts and $4\frac{1}{2}$ quarts, for example, can be used in a single magnetic utensil-holder.

The second ring 20, which is also substantially circular, has a first end 22 and a second end 24. The handle means 26 are attached to the two ends 22 and 24. Handle means 26 are attached to the two ends 22 and 24 as shown with a suitable bonding means, such as by welding.

Atop each of the wide supports 30 are extension pins 40 which project upwardly a desired distance such as $1\frac{1}{2}''$ or so and serve to prevent pot lids from sliding off of utensils located within the utensil holder. In this manner it is not necessary to use the customary wires or cables to fasten pot lids in place; and, moreover, the use of these extension pins make it easier and safer for cooks to obtain access to the contents of the pots. These extension pins are also operative in combination with supplemental joining or fastening bars 45 (FIG. 6) to fasten two or more magnetic utensil-holders together. That is, elongated holes 47 in the supplemental fastening bar permit it to be placed over an extension pin 40 on a first utensil holder of the invention and a second extension pin 40*a* on a second utensil holder of the invention. In this manner two or more utensil holders can be fastened together on a grill top, for example, to assist each other by broadening the effective fastening perimenter on the grill.

In use, the magnetic utensil-holder is placed on a cooking surface, such as a stove top or grill, in such a manner that the heat of the stove or grill is within the area defined by the holder. The magnets 19 on the first ring are attracted to the metal of the stove top or grill, creating a fixture that does not easily move. A cooking utensil, such as a pot is placed in the magnetic utensil holder 10 and the adjustment means 33 are adjusted until they make contact with the pot. In this manner, movement of the vehicle will not cause the pot to shift its position with respect to the cook top. When one is finished cooking, the pot is removed and the magnetic utensil-holder 10 is lifted by its handle 26, which will be at a lower temperature than the rest of the holder due to its distance away from the direct heat source of the cooking surface.

While the invention has been particularly shown and described with reference to the preferred embodiments thereof, it will be understood by those skilled in the art that various alterations in form and detail may be made therein without departing from the spirit and scope of the invention. For example, slots may be made in the compound ring 12 to accommodate grates or the like that may be used on a stove.

The embodiments of the invention in which an exclusive property or privilege is claimed are defined as follows:

1. A magnetic utensil-holder for preventing movement of a cooking utensil placed on a cooking surface, comprising:

frame means, including:

first ring means having a substantially circular shape;

means for magnetically securing said first ring means to said cooking surface;

second ring means having a substantially circular shape; and, means for supporting said second ring means a predetermined distance above said first ring means; and, means on said frame means for adjusting said holder to accommodate various utensil sizes.

2. A magnetic utensil-holder as recited in claim 1 wherein said magnetic securing means comprises at least one cylinder having a magnet therein, said cylinder being attached to said first ring means.

3. A magnetic utensil-holder as recited in claim 1 wherein said second ring means includes a handle to facilitate the handling of said magnetic utensil-holder.

4. A magnetic utensil-holder as recited in claim 1 wherein said adjustment means comprises a screw that is screwed through a threaded hole in said supporting means, said screw being adjusted until it contacts a cooking utensil placed in said magnetic utensil-holder.

5. A magnetic utensil holder as recited in claim 1 wherein said first and second ring means and supporting means are manufactured from a heat resistant material.

6. A magnetic utensil-holder as recited in claim 5 wherein said heat resistant material is stainless steel.

7. The magnetic utensil-holder of claim 1 including fastening bar means for selectively engaging said frame means and including means for selectively engaging a second magnetic utensil-holder located adjacent the first magnetic utensil-holder.

8. The magnetic utensil-holder of claim 1 wherein said frame means includes a plurality of extension pins extending upwardly therefrom for preventing lids on said utensils from sliding off during cooking.

9. The magnetic utensil-holder of claim 8 including fastening bar means for selectively engaging one of said extension pin means and including means for selectively engaging an extension pin on a second such magnetic utensil-holder located adjacent the first magnetic utensil-holder.

10. A magnetic utensil-holder for preventing the movement of a cooking utensil while on a cooking surface comprising:

frame means, including:

first ring means having a substantially circular shape, said first ring means being made of a material capable of withstanding the heat produced by said cooking surface;

magnetic means attached to said first ring means for securing said first ring means to said cooking surface;

second ring means having a substantially circular shape, said second ring means being made from a material capable of withstanding the heat produced by said cooking surface;

means for supporting said second ring means a fixed distance above said first ring means, said supporting means being made from a material capable of withstanding the heat produced by said cooking surface; and, adjustment means attached to said frame means for accommodating various utensil sizes.

11. A magnetic utensil-holder as recited in claim 10, wherein said magnetic means attached to said first ring means comprises a cylinder having a closed top and an open bottom, said cylinder having a magnet place inside and secured to said cylinder.

12. A magnetic holder as recited in claim 10, wherein said second ring means has an integral handle to facilitate handling of said magnetic utensil-holder.

13. A magnetic holder as recited in claim 10, wherein said adjustment means comprises a screw means and a threaded hole placed in said frame means for accommodating said screw means, said screw means being adjustable until said screw means contacts a cooking utensil that has been placed in said magnetic utensil-holder.

14. A magnetic holder as recited in claim 10, wherein said first and second ring means and said supporting means are manufactured from stainless steel.

15. The magnetic utensil-holder of claim 10 including fastening bar means for selectively engaging said frame means and including means for selectively engaging a second magnetic utensil-holder located adjacent the first magnetic utensil-holder.

16. The magnetic utensil-holder of claim 10 wherein said frame means includes a plurality of extension pins extending upwardly therefrom for preventing lids on said utensils from sliding off during cooking.

17. The magnetic utensil-holder of claim 16 including fastening bar means for selectively engaging one of said extension pin means and including means for selectively engaging an extension pin on a second such magnetic utensil-holder located adjacent the first magnetic utensil-holder.

18. A magnetic utensil-holder for preventing the movement of a cooking utensil while on a cooking surface, comprising;

frame means, including:

first ring means having a substantially circular shape, said first ring means being manufactured from a material capable of withstanding the heat produced forms aid cooking surface;

a plurality of cylinder means attached to said first ring means, said cylinder means each having a closed top and an open bottom;

magnet means placed inside of each of said cylinders and secured to said cylinders, said magnets securing said first ring means to said cooking surface;

second ring means having a substantially circular shape, said second ring means being manufactured from a material capable of withstanding the heat produced from said cooking surface;

handle means integrally formed in said second ring means to facilitate handling of said magnetic utensil-holder;

means for supporting said second ring a predetermined distance above said first ring means, said supporting means being manufactured from a material capable of withstanding the heat produced from said cooking surface; and, adjustment means attached to said frame means to accommodate various size cooking utensils placed in said magnetic utensil holder.

19. The magnetic utensil-holder of claim 18 including fastening bar means for selectively engaging said frame means and including means for selectively engaging a second magnetic utensil-holder located adjacent the first magnetic utensil-holder.

20. The magnetic utensil-holder of claim 18 wherein said frame means includes a plurality of extension pins extending upwardly therefrom for preventing lids on said utensils from sliding off during cooking.

21. The magnetic utensil-holder of claim 20 including fastening bar means for selectively engaging one of said extension pin means and including means for selectively engaging an extension pin on a second such magnetic utensil-holder located adjacent the first magnetic utensil-holder.

* * * * *